US005634485A

United States Patent [19]

Holtby

[11] Patent Number: 5,634,485

[45] Date of Patent: Jun. 3, 1997

[54] METHOD AND APPARATUS FOR RETROFITTING DRILLING RIGS WITH A CATCH PAN

[76] Inventor: Quinn Holtby, 3611 - 111B Street, Edmonton, Alberta, Canada, T6J 1G9

[21] Appl. No.: 561,318

[22] Filed: Nov. 21, 1995

[30] Foreign Application Priority Data

Nov. 22, 1994 [CA] Canada ..... 2136375

[51] Int. Cl.[6] ..... E21B 33/08

[52] U.S. Cl. ..... 137/15; 137/312; 137/315; 166/81.1

[58] Field of Search ..... 137/15, 312, 315; 166/81.1, 162, 250.08, 337, 358

[56] References Cited

U.S. PATENT DOCUMENTS

| | | | |
|---|---|---|---|
| 1,507,628 | 9/1924 | Schuyler | 166/81.1 |
| 2,137,832 | 11/1938 | Cordes | 166/81.1 |
| 5,121,796 | 6/1992 | Wigington, Sr. | 166/81.1 |
| 5,167,277 | 12/1992 | Evans | 166/81.1 |
| 5,228,506 | 7/1993 | Pearce | 166/81.1 |
| 5,343,943 | 9/1994 | Norris et al. | 166/81.1 |
| 5,377,748 | 1/1995 | Gayaut | 166/162 |
| 5,394,939 | 3/1995 | Walker | 166/81.1 |

*Primary Examiner*—George L. Walton
*Attorney, Agent, or Firm*—Anthony R. Lambert

[57] ABSTRACT

A method for retrofitting existing drilling rigs with a catch pan. Firstly, provide a pan-like body consisting of two portions. Each portion includes an interior edge having a semi-circular indentation with depending semi-cylindrical collar. Latches are provided to secure the interior edges in abutting relation with the semi-cylindrical collars mating to form a cylindrical collar. Secondly, secure the body to a flow nipple disposed below an opening in a drilling platform by positioning the semi-circular indentations with depending semi-cylindrical collars one opposed sides of the flow nipple, and using the latches means to secure the interior edges in abutting relation. Drilling fluids from the drilling platform are caught in the pan-like body and directed into the flow nipple.

2 Claims, 3 Drawing Sheets

METHOD AND APPARATUS FOR RETROFITTING DRILLING RIGS WITH A CATCH PAN

FIELD OF THE INVENTION

The present invention relates to a method and apparatus for retrofitting drilling rigs with a catch pan.

BACKGROUND OF THE INVENTION

Large drilling rigs have an area sometimes referred to as a "cellar" positioned directly under them. The cellar is a 40×50×60 foot space in which are positioned blow out preventers, pumps and other equipment. The height of the equipment configurations is such that great care must be taken during servicing. A fall from the equipment can kill or severely injure a worker. These large drilling rigs are located at one drilling site for approximately one year, and during that time period servicing is inevitably required.

With most drilling rigs, drilling fluids leak down from the drilling rig floor into the cellar. With large drilling rigs this is totally unacceptable, due to the safety hazard it creates. For this reason, large drilling rigs are presently being manufactured with large "catch pans" welded to the underside of the drilling platform under the rotary table. The catch pan catches drilling fluids from the drilling rig platform and direct them into a sump. The contents of the sump are periodically pumped out by a tank truck and hauled away. It will be understood that the use of a catch pan both addresses the safety concern described above and provides a secondary benefit of reducing the amount of environmental contamination at a drill site.

SUMMARY OF THE INVENTION

What is required is method and apparatus for retrofitting drilling rigs with a catch pan.

According to one aspect of the present invention there is provided a method for retrofitting existing drilling rigs with a catch pan. Firstly, provide a pan-like body consisting of two portions. Each portion includes an interior edge having a semi-circular indentation with depending semi-cylindrical collar. Latching means are provided to secure the interior edges in abutting relation with the semi-cylindrical collars mating to form a cylindrical collar. Secondly, secure the body to a flow nipple disposed below an opening in a drilling platform by positioning the semi-circular indentations with depending semi-cylindrical collars one opposed sides of the flow nipple, and using the latching means to secure the interior edges in abutting relation. Drilling fluids from the drilling platform are caught in the pan-like body and directed into the flow nipple.

With the method, as described above, a drilling rig not having a catch pan can be quickly retrofitted. The catch pan, as described, catches drilling fluids to address safety and environmental concerns. However, it also plays an expanded role due to its positioning on the flow nipple. Instead of being connected to a sump, fluids caught in the catch pan flow directly into the flow nipple. This enables drilling fluids to be recycled. The flow can be facilitated by placing openings or flow channels through a sidewall of the flow nipple above the point of attachment. The catch pan will also catch tools and other debris that may fall from the rig floor. It is preferred that sealing means be positioned between the interior surface of the cylindrical collar and a flange on the flow nipple to eliminate leakage.

According to another aspect of the invention there is provided a catch pan for drilling rigs which includes a combination of elements. A shallow pan-like body is provided which consists of two portions. Each portion includes an interior edge having a semi-circular indentation with depending semi-cylindrical collar. Upon the interior edges of the portions being abutted a generally circular opening with depending cylindrical collar is formed. Latching means are provided to secure the interior edges in abutting relation.

It is preferred that an annular seal be secured to a flange of a flow nipple at the time of installation of the catch pan. Smaller drilling rigs are only located at a drill site for approximately 7 days. During that 7 day period the drilling rig may settle down as much as 5 inches. An annular seal secured to the flange of the flow nipple accommodates relative movement between the flow nipple and an interior surface of the semi-cylindrical collars of the catch pan body. As the drilling rig settles, it merely pushes the pan-like body down. The downward movement of the pan-like body is accommodated by interior surface of the semi-cylindrical collars sliding passed the annular seal which is fixed to the flange.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 3:
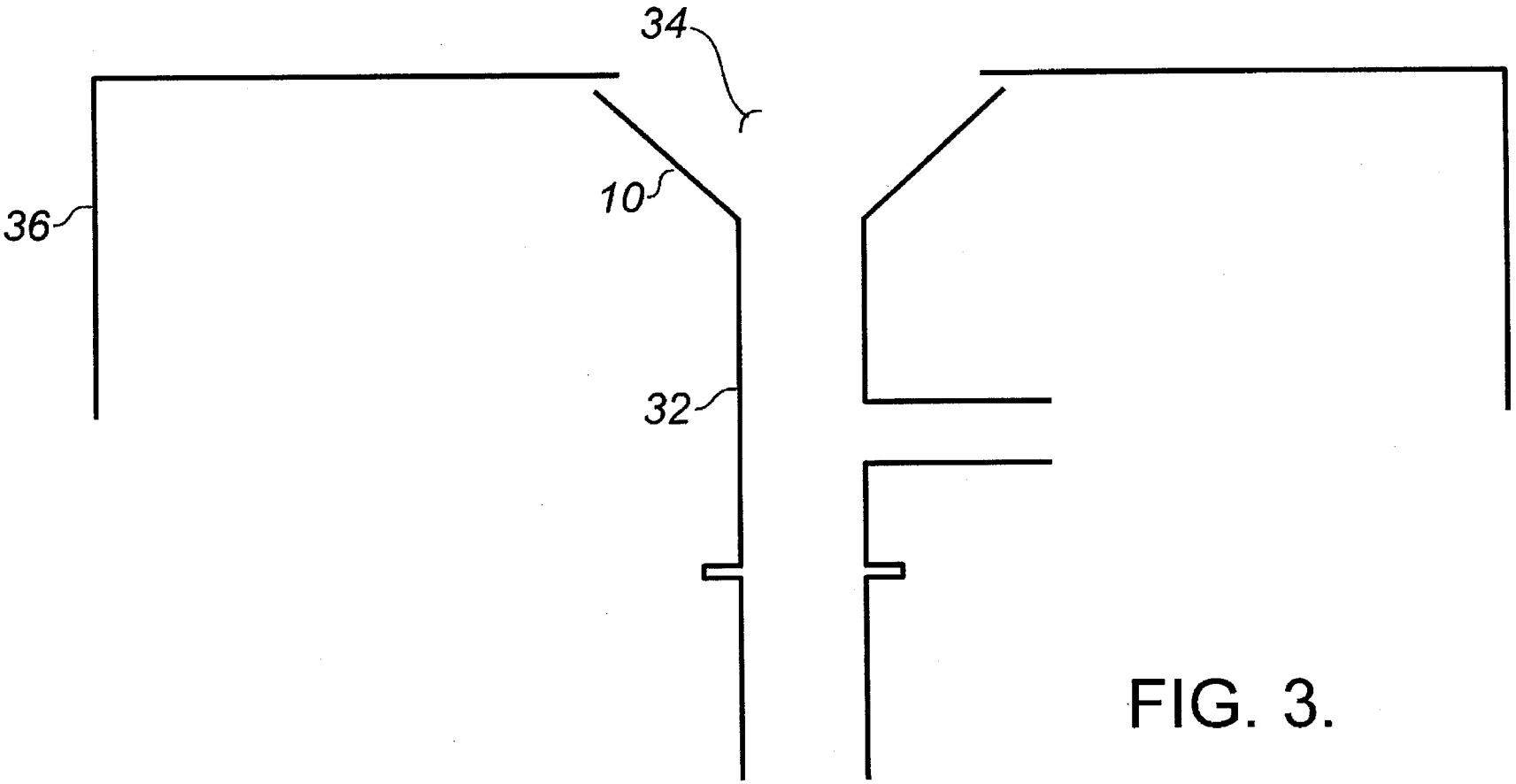
FIG. 3 is a side elevation view in section of the catch pan apparatus illustrated in FIG. 1, in position beneath an opening in a drilling platform in accordance with the teachings of the method.

The preferred embodiment, a catch pan for drilling rigs generally identified by reference numeral 10, will now be described with reference to FIGS. 1 and 3.

Figure 1:
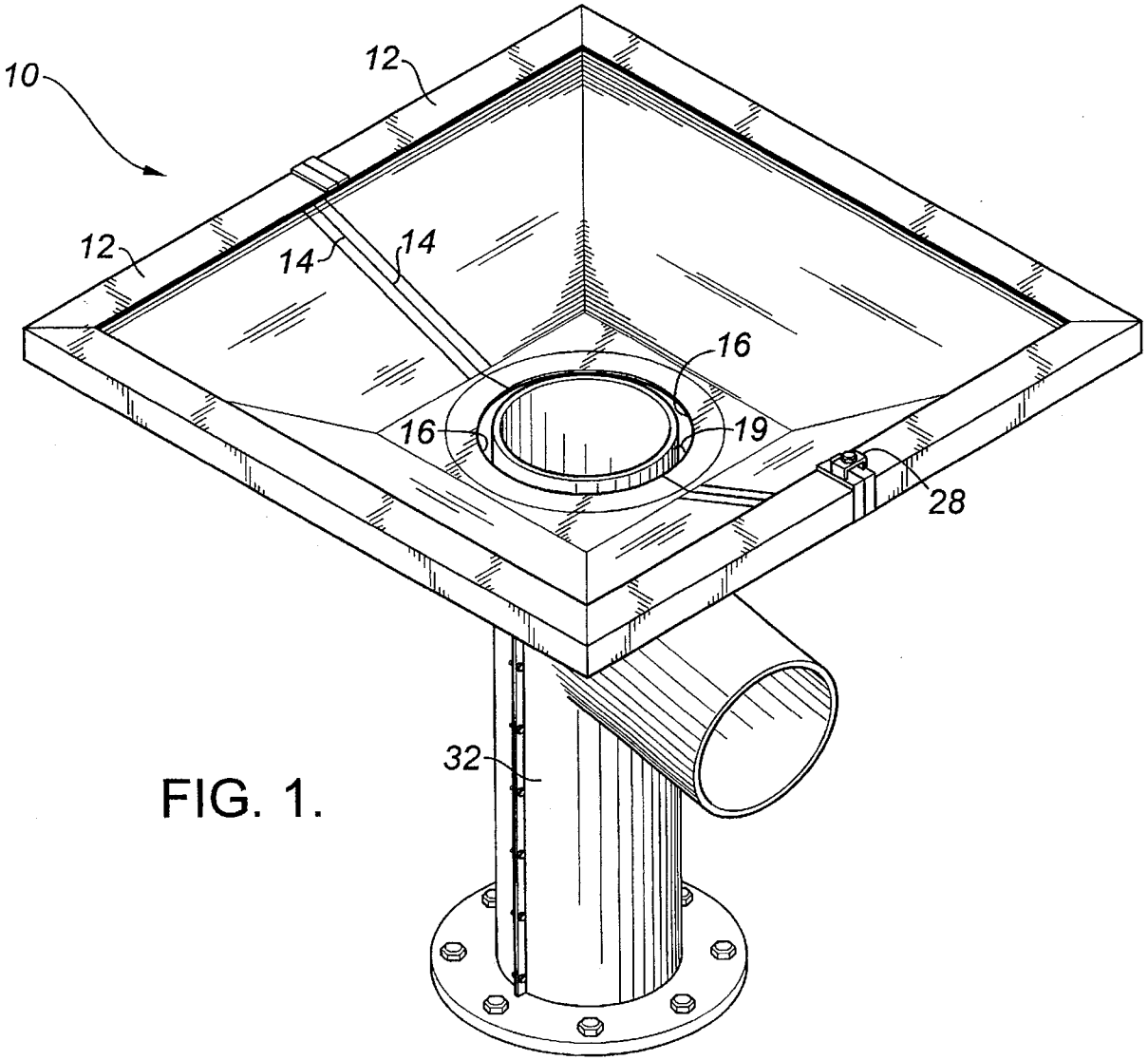
FIG. 1 is perspective view of a catch pan apparatus in position on a flow nipple in accordance with the teachings of the method.
Figure 2:
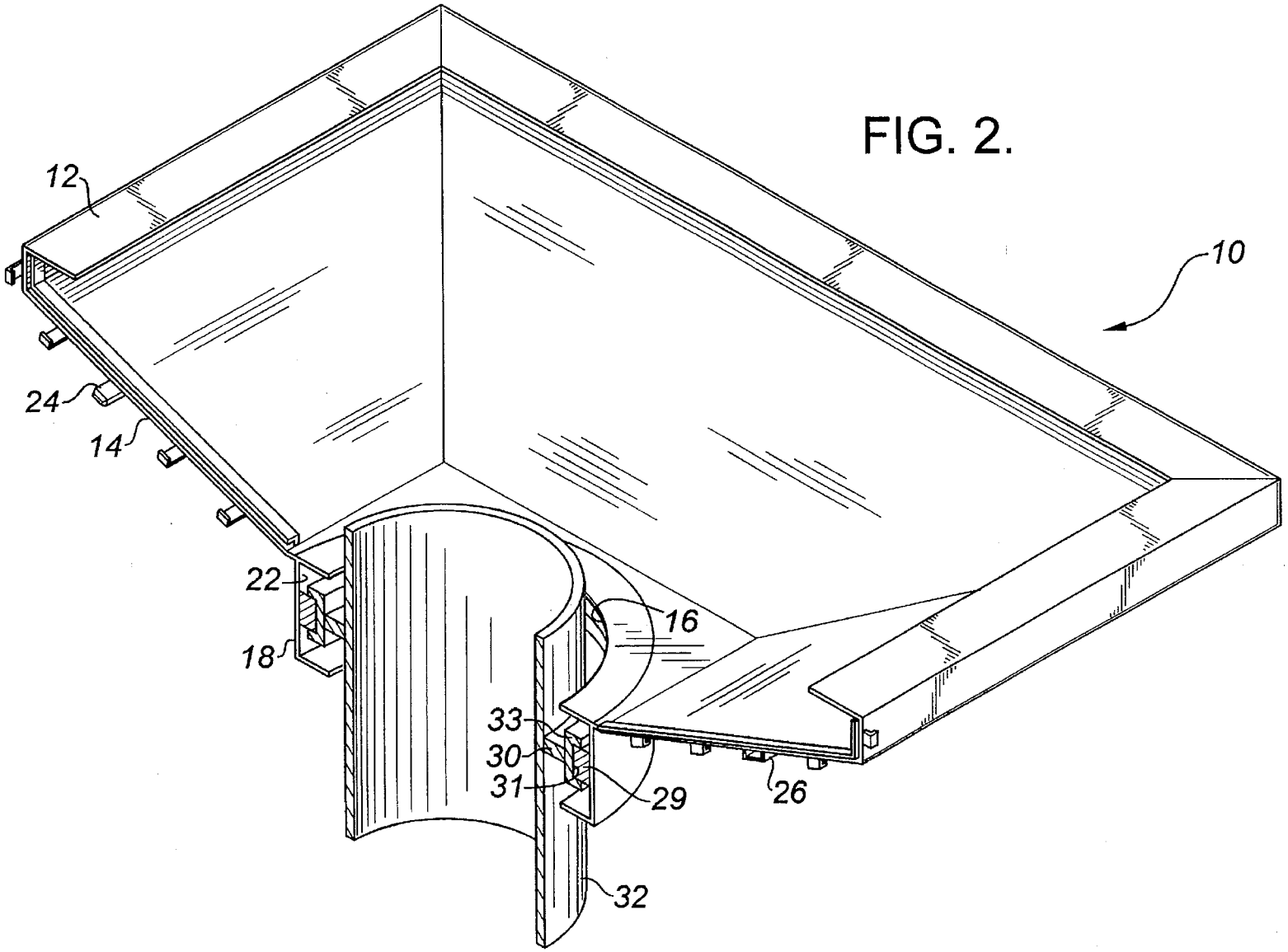
FIG. 2 is a side elevation view in section of the catch pan apparatus illustrated in FIG. 1, in position on the flow nipple in accordance with the teachings of the method.

Referring to FIG. 1, catch pan 10 consists of two portions 12. Each of portions 12 include an interior edge 14 having a semi-circular indentation 16. Referring to FIG. 2, semi-circular indentation 16 has a depending semi-cylindrical collar 18 with an interior surface 22. Referring to FIG. 1, upon interior edges 14 of portions 12 being abutted semi-circular indentations 16 form a generally circular opening 19 and depending semi-cylindrical collars 18 mate to form a cylindrical collar. Latching means are provided to secure interior edges 14 in abutting relation. Referring to FIG. 2, the latching means includes a plurality of male members 24 and female members 26 on each of portions 12. Male members 24 that protrude substantially perpendicularly past interior edges 14. Female members 26 are positioned substantially perpendicularly and adjacent interior edges 14. When interior edges 14 are abutted male members 24 extend into female members 26. Referring to FIG. 1, a pivotally mounted latching member 28 is provided that holds interior edges 14 in abutting relation and prevents male members 24 from being withdrawn from female members 26. An annular seal 29 is provided as will hereinafter be described. Seal 29 is positioned in a groove 31 of an annular seal mounting ring 33.

The method for retrofitting drilling rigs with a catch pan will now be described with reference to FIGS. 1 and 3.

Firstly, provide a catch pan 10 consisting of two portions 12; preferably as has been described with reference to FIGS. 1 and 2. Secondly, secure catch pan 10 to a flow nipple 32 disposed below an opening 34 in a drilling platform 36. Referring to FIG. 2, semi-circular indentations 16 with depending semi-cylindrical collars 18 are positioned on opposed sides of flow nipple 32. The latching means are then used to secure interior edges 14 in abutting relation. Annular seal mounting ring 33 is welding to a flange 30 on flow nipple 32. Seal 29 is then positioned in groove 31 of annular seal mounting ring 33. When positioned on flange 30, as described, seal 29 engages interior surfaces 22 of semi-cylindrical collars 18.

With the method, as described above, a drilling rig can be quickly retrofitted with catch pan 10. When catch pan 10 is positioned, as described, tools and other objects are prevented from falling down the annulus of the borehole. In addition, drilling fluid is captured for recycling back into flow nipple 32. Referring to FIGS. 1 and 2, a sidewall 38 of flow nipple 32 can be provided with slotted flow channels 40 to enhance fluid flow. As the drilling rig settles, the weight of the drilling rigs will come to rest upon catch pan 10 pushing it downward relative to flow nipple 32. When this occurs, interior surfaces 22 of semi-cylindrical collars 18 merely slides passed seal 29.

There are alternate ways of mounting seal 29 to flange 30. Welding has come to be preferred, however, due to the strain placed upon seal 29 when objects fall into catch pan 10 or when drilling rig 36 settles onto catch pan 10 pushing it downward passed seal 29.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method for retrofitting existing drilling rigs with a catch pan, comprising the following steps:

firstly, providing a pan-like body consisting of two portions, each portion including an interior edge having a semi-circular indentation with depending semi-cylindrical collar, the semi-cylindrical collars having interior surfaces, latching means being provided to secure the interior edges in abutting relation such that the semi-cylindrical collars mate to form a cylindrical collar with a cylindrical interior sealing surface; and secondly, providing an annular seal;

thirdly, securing the annular seal to a flow nipple disposed below an opening in a drilling platform;

fourthly, positioning the semi-circular indentations with depending semi-cylindrical collars on opposed sides of the flow nipple with the cylindrical interior sealing surface of the cylindrical collar engaging and being telescopically movable relative to the annular seal, and using the latching means to secure the interior edges in abutting relation, such that drilling fluids from the drilling platform are caught in the pan-like body and directed into the flow nipple and as the drilling platform settles, such settling is accommodated by movement of the cylindrical interior sealing surface of the cylindrical collar relative to the annular seal.

2. A catch pan for drilling rigs, comprising:

a shallow pan-like body consisting of two portions, each portion including an interior edge having a semi-circular indentation with depending semi-cylindrical collar, such that upon the interior edges of the portions being abutted a generally circular opening with a depending cylindrical collar is formed, the cylindrical collar providing a cylindrical interior sealing surface;

latching means to secure the interior edges in abutting relation;

an annular seal having an interior attachment portion and an exterior wiper portion, the attachment portion being adapted for attachment to a flange of a flow nipple, the wiper portion engaging the interior sealing surface, the cylindrical interior sealing surface of the cylindrical collar being telescopically movable relative to the annular seal, thereby accommodating movement of the pan-like body relative to the flow nipple when a downward force is exerted upon the pan-like body by a settling drilling platform.

* * * * *